United States Patent [19]

Müller et al.

[11] Patent Number: 4,696,577

[45] Date of Patent: Sep. 29, 1987

[54] INTEGRAL WATCH CASE MIDDLE AND MOVEMENT PLATE AND METHOD OF MAKING SAME

[75] Inventors: Jacques Müller, Reconvilier; André Triponez, Lamboing, both of Switzerland

[73] Assignee: ETA S.A. Fabriques d'Ebauches, Grenchen, Switzerland

[21] Appl. No.: 900,924

[22] Filed: Aug. 27, 1986

[30] Foreign Application Priority Data

Sep. 6, 1985 [CH] Switzerland ..... 03857/85

[51] Int. Cl.[4] ..... G04B 57/00

[52] U.S. Cl. ..... 368/276; 368/280; 368/286; 368/299

[58] Field of Search ..... 368/276, 280, 285, 286, 368/294–295, 299–300, 301, 318; 29/177, 179

[56] References Cited

U.S. PATENT DOCUMENTS

| | | | |
|---|---|---|---|
| 360,477 | 4/1887 | Potter | 368/299 |
| 3,726,082 | 4/1973 | Kushida | 368/283 |
| 3,789,605 | 2/1974 | Kishida | 368/280 |
| 3,911,670 | 10/1975 | Hofer | 368/280 |

FOREIGN PATENT DOCUMENTS

| | | | |
|---|---|---|---|
| 1988992 | 3/1968 | Fed. Rep. of Germany . | |
| 1453876 | 12/1965 | France . | |
| 57-3069 | 8/1982 | Japan | 368/280 |
| 66161 | 10/1913 | Switzerland | 368/299 |
| 183261 | 9/1936 | Switzerland . | |
| 250700 | 7/1948 | Switzerland . | |

*Primary Examiner*—Vit W. Miska

*Attorney, Agent, or Firm*—Pollock, Vande Sande & Priddy

[57] ABSTRACT

A watch middle cum plate is described that comprises an annular middle-forming portion and a plate-forming portion which is surrounded by the middle-forming portion and which is formed with recesses for receiving components of the watch movement. The middle cum plate is provided with a protective coating of which a first part essentially covers the plate-forming portion and of which a second, thicker, more resistant part covers at least the visible surfaces of the middle-forming portion.

Such middles cum plates may be made from flat brass blanks by machining recesses in their central portion for receiving components of a watch movement, by applying to the blanks a layer of material that is chemically more inert than brass to form the first part of the above coating, stacking and assembling the blanks such that at least the above central portions of the blanks with the recesses are masked, and applying to the visible regions of the stacked and assembled blanks the above second part of the coating.

18 Claims, 7 Drawing Figures

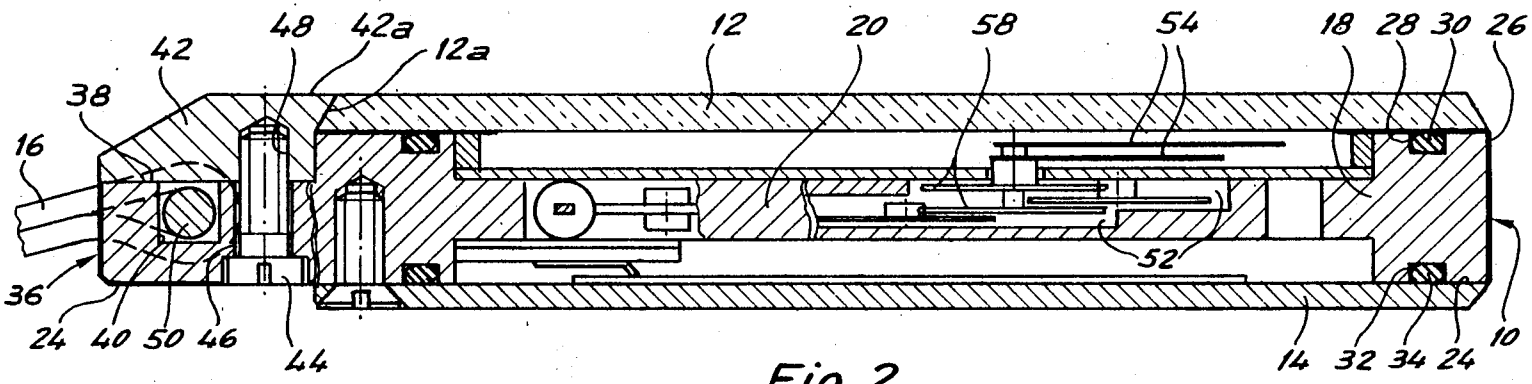
Fig. 2
Fig. 3
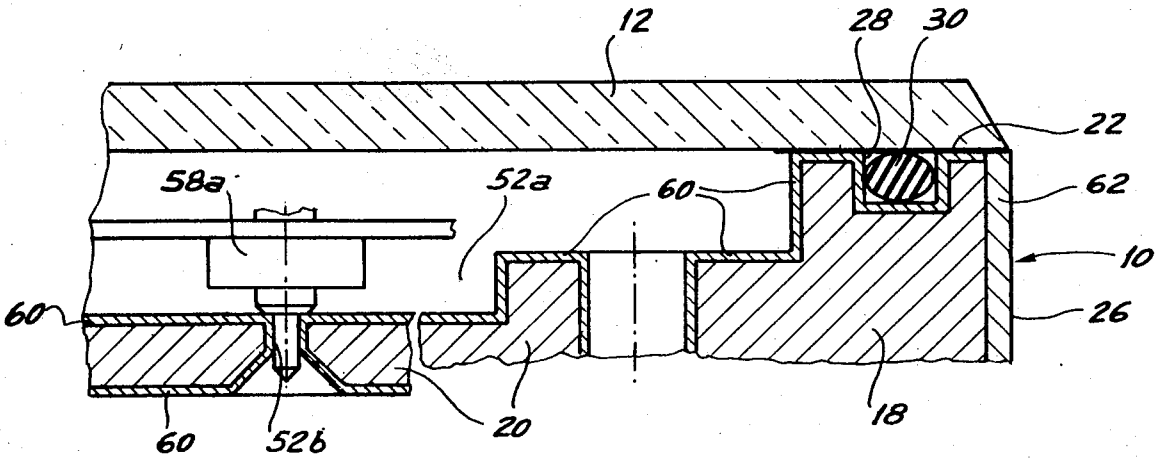

INTEGRAL WATCH CASE MIDDLE AND MOVEMENT PLATE AND METHOD OF MAKING SAME

BACKGROUND OF THE INVENTION

According to a first aspect, the invention provides a watch middle cum plate made of brass of the kind which comprises top and bottom faces, at least one of them being formed with recesses for receiving components of a watch movement and side faces, and which is provided with a coating made of a material that is chemically more inert than brass.

Watches fitted with middles cum plates of the above kind have been described in many published patent specifications, e.g. Swiss patent specifications Nos. 296, 6502 and 250700, and French patent specification No. 2085292. So far, however, the number of such middles cum plates actually to have been produced has at best been extremely small.

As is known, brass is very often used in watch-making, in particular for making watch plates and watch cases. One advantage of this material is that it can readily be machined. On the other hand it is very subject to oxidation.

To overcome this drawback, the plates are generally coated with a layer of nickel which in turn may be clad with gold. The thickness of this layer does not usually exceed 2 μm. This suffices to protect the brass while hardly affecting the dimensions of the plates.

In the manufacture of watch cases, the brass is coated with a layer of chromium, gold or any other suitable protective material. The protective layer on the cases must be much more resistant than that on the plates as it is subject to many kinds of attack, both physical and chemical. A layer of 2 μm is therefore not enough. In practice, the thickness is generally of at least 5 μm and may exceed 20 μm. Such added thickness on the plates would considerably increase the spread in value of the dimensions and the resulting plates would be unfit for automated assembly of the components.

Thus, the production of a watch having a middle cum plate made of brass gives rise to the following dilemma: either an effective protection is provided in which case the brass needs a thick protective coating thus making assembly difficult, or a coat is provided that is sufficiently thin so as not to affect assembly, in which case the exposed surfaces of the watch are not adequately protected.

Swiss patent specifications Nos. 296 and 6502 do not discuss the problem set by this dilemma. Swiss patent specification No. 250700 does, and proposes making the plate-forming portion out of brass and the middle-forming portion out of steel, these two portions being then assembled by welding or by force-fitting. If at first this idea might seem attractive, it should be borne in mind that the considerable stresses that may be generated in so doing are likely to deform the plate-forming portion thereby making it unfit for automated assembly.

French patent specification No. 2 085 292 suggests using aluminium, copper, metal alloys and synthetic materials to produce a middle cum plate and not to apply a protective layer. None of these materials would it is believed enable sufficient accuracy to be achieved for the plate-forming portions to enable automated assembly, unless it is an alloy such as brass which, because of its propensity for oxidation, must be provided with a protective coating.

SUMMARY OF THE INVENTION

An object of the invention is to provide a middle cum plate of the kind set forth, but in which the middle-forming portion affords a good resistance to chemical and physical attack, without however the assembly of the components of the watch movement being made more complicated.

To this end, the coating comprised by the above set forth middle cum plate includes a first part that protects the brass in the regions of the middle cum plate that are formed with recesses and a second part that protects the brass at least over said side faces and which is thicker and more resistant to chemical and physical attack than the first part.

In so doing a watch middle cum plate can be produced in which the plate-forming portion may readily be made with sufficient accuracy while providing a middle-forming portion that is particularly resistant to both chemical and physical attack.

According to a second aspect, the invention also provides a method of making watch middles cum plates from flat brass blanks.

In known methods of applying a protective coating, a large part of the cost is attributable to the machines they require, to the space occupied by the machines and to the multiple handling operations.

The method provided by the invention helps to reduce this cost and comprises forming recesses in the central portion of at least one of said top and bottom faces of each blank for receiving components of a watch movement, applying to the blanks a layer of material that is chemically more inert than brass to form a first part of a protective coating, stacking and assembling the blanks such that at least the central portions with the recesses are masked, and applying to the visible regions of the blanks a protective layer for said side faces and forming a second part of said coating that is thicker and more resistant to chemical and physical attack than the first part.

With known manufacturing methods, middles, and more particularly the surfaces thereof that are visible in a finished watch, are machined one after another, thereby increasing the cost of production. Moreover, when machining the periphery of middles cum plates after having applied a protective layer to the recesses, chips and lubricant are liable to damage the surface of this layer.

To reduce the cost of manufacture while enabling machining operations to be done after application of this layer without adverse effects, the side faces of the blanks once stacked and assembled as set forth above are machined at the same time to define the outer shape of their middle-forming portions before applying the second part of the coating.

According to a third aspect of the invention, the invention provides also a watch having a middle cum plate as defined above, a glass and a back.

As pointed out earlier, the manufacture on an industrial scale of watches fitted with middles cum plates has not so far been possible because of the difficulty in resolving the above indicated dilemma, i.e. the very divergent conditions required for automating assembly and for resisting the various kinds of attack to which a watch is subjected in use.

To avoid this difficulty in the watch provided by the invention, the second part of the coating protects the middle cum plate over the portions thereof that are not overlaid by the glass and by the back.

BRIEF DESCRIPTION OF THE DRAWINGS

In the accompanying drawings, given by way of example:

FIG. 2 is a cross-section along line II—II of FIG. 1;

FIG. 3 shows on an enlarged scale a detail of FIG. 2;

In the several Figures, the same reference numerals have been used to designate corresponding parts.

DETAILED DESCRIPTION

Figure 1:
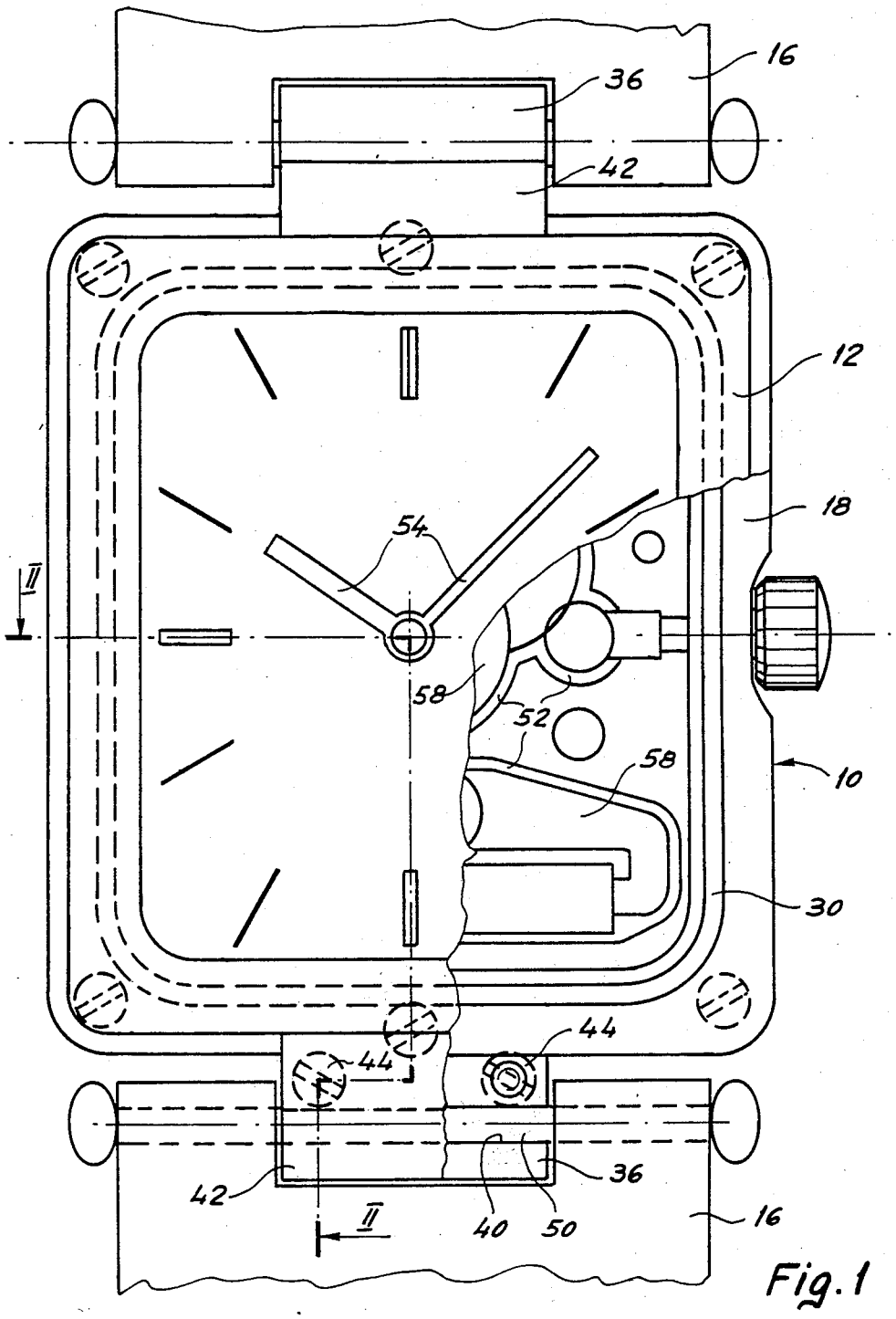
FIG. 1 is a plan view partly broken away of a watch having a middle cum plate according to the invention.

The watch shown in FIGS. 1 to 3 comprise a middle cum plate 10 bearing the various cmponents of the watch movement, a glass 12 and a back 14 that protect these components, and a wristlet 16.

The middle cum plate 10 comprises a first, middle-forming, portion 18 of annular shape and a second, plate-forming, portion 20 surrounded by portion 18. First portion 18 and second portion 20 together form an integral watch case middle and movement plate.

Middle-forming portion 18 has a top face 22, a bottom face 24 on which bear glass 12 and back 14 respectively, and side faces 26.

Top face 22 is formed with a peripheral groove 28 for receiving a gasket 30 to ensure fluid tightness between the middle cum plate 10 and glass 12. Bottom face 24 is formed with a peripheral groove 32 for receiving a gasket 34 to ensure fluitightness between the middle cum plate 10 and back 14.

Side faces 26 are formed with a pair of lugs 36 in opposed relationship, each lug having a bearing surface 38 and being formed with a groove 40. Bearing surfaces 38 are parallel to faces 22 and 24. They carry dogs 42 for securing glass 12, each formed with a beak 42*a* co-operating with a bevel 12*a* on glass 12 (see FIG. 2). Dogs 42 are secured to lugs 36 by screws 44 extending through smooth holes 46 in lugs 36 and tightened in tapped holes 48 in dogs 42.

Bars 50 for attaching wristlet 16 are housed in grooves 40 and kept there by dogs 42.

Plate-forming portion 20 is formed with recesses 52 in which are housed various components of the watch movement. The illustrated components include the hands 54 of the display means, and certain parts of the means for driving, controlling and correcting the display means, diagrammatically shown at 58.

Some recesses require relatively little accuracy, but others, such as recess 52*a* (FIG. 3), which has a hole 52*b*, require much greater accuracy. This is because hole 52*b*, which acts as a bearing for a wheel 58*a*, must have a well defined diameter and position to ensure proper meshing of the wheels and pinions of the watch movement.

Thus, to produce a brass plate in which even the closest tolerances are respected and whose surface is protected, the latter is coated with a layer 60 of a noble or passivatable material, such as gold or nickel, having a thickness varying from 0.5 to 3 μm, typically 2 μm.

Such a protective layer 60 amply suffices to preserves the appearance of plate-forming portion 20 which is protected from outside attack by glass 12 and back 14. But it is not at all suited to protect side faces 26 which are subjected to physical attack, such as from abrasion or shock, or to chemical attack, such as from sweat. To overcome this problem, side faces 26 and those portions of bottom face 24 that are not covered by back 14, are coated with a layer 62 of a material that is chemically more inert than brass and more resistant than layer 60 to chemical and physical attack. This material may be chromium, gold, titanium or aluminium, or be a carbide or nitride of a metal selected from among titanium, vanadium and tungsten, or be a layer of organic material such as organic paint or rubber.

When layer 62 is made of one of these metals or metal components, its thickness best ranges from 5 to 30 μm, and is typically 10 μm. It imparts to the exposed regions a much better resistance than that afforded by a brass component even if it is protected by a layer 60 of nickel or gold, as is the case with the plate-forming portion.

When the layer is of gold its thickness generally exceeds 8 μm so as to qualify as "gold plated".

When the layer is of aluminium applied by galvanization, its thickness ranges from 20 to 30 μm. This layer is then hardened and coloured by anodic treatment.

The aluminium layer may be applied by the method described by U. Landau in pages 317 to 324 of the report on the conference "Interfinish Europe" held in Berlin in 1985.

When layer 62 is of rubber, its thickness best ranges from 0.5 to 1mm. In this case, the gaskets 30 and 34 are best moulded integrally with the protective layer 62.

It is also possible for layer 62 to consist of paint, generally enamel paint and best deposited by electrophoresis.

Figure 4:
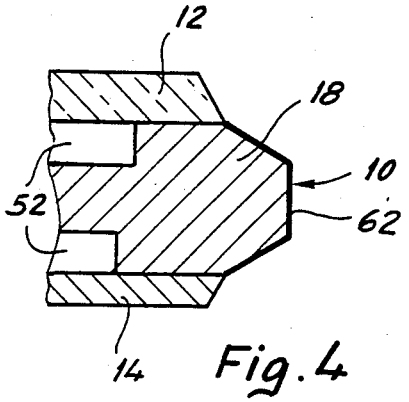
FIGS. 4 and 5 illustrate in cross-section, two modified constructions of a detail of FIG. 2.

In the modification of FIG. 4, middle-forming portion 18 of middle cum plate 10 protrudes beyond glass 12 and back 14 and is formed with peripheral bevels. In this modification, the protruding part of portion 18 is entirely coated with protective layer 62, represented by a thick line. As will become apparent hereinafter, glass 12 and back 14 are best aligned vertically one with the other.

Figure 5:
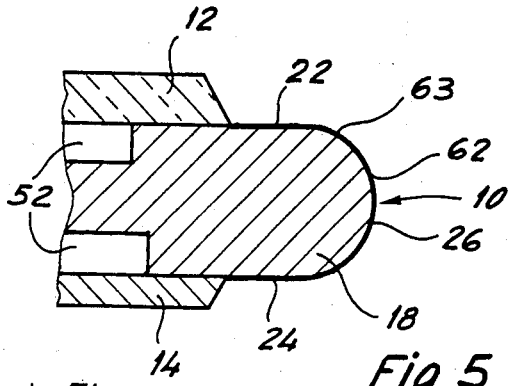

In the modification of FIG. 5, the part of portion 18 protruding beyond glass 12 and back 14 is also entirely coated with protective layer 62. In this modification, side face 26 is rounded as at 63 to provide smooth merging with top and bottom faces 22 and 24.

Portion 18 can take many forms. In each case however the brass must be provided with protective coating 62 where it is not overlaid. If desired the layer may extend on to the faces overlaid by back 14 or glass 12 but not on to the surfaces of recesses 52 for the reasons given earlier.

Middles cum plates such as shown in FIGS. 1 to 5 are made from a strip of brass that is cut up into blanks of any shape, e.g. round or rectangular, and of a size larger than that of the finished middles cum plates. These blanks are first machined to the required thickness and are then machined to form the recesses 52 for accommodating movement components and to form holes such as locating holes for positioning the blanks during subsequent manufacturing operations. or such as bearing holes for receiving the pivots of wheels and pinions.

The machining of plate-forming portion 20 and of the top and bottom faces 22 and 24 being complete, the blanks are first cleaned and then coated with protective layer 60, generally galvanically. This completes the surface conditioning of portion 20 and of faces 22 and 24. Side faces 26, however, are still in a raw state. They need to be machined to define the outline of the middle-forming portion 18 and to produce the wristlet fixing means. These operations differ notably from those required to machine plate-forming portion 20. Although less accuracy is required, the state of the surfaces should on the other hand be flawless. Further, the shape must be reaily modifiable from one blank to another so as to increase scope for creative design.

Figure 6:
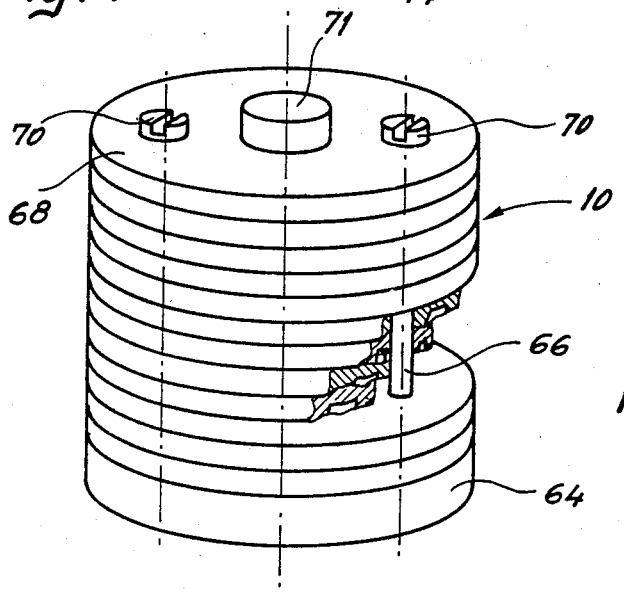
FIG. 6 is a perspective view partly broken away, of a stack of middles cum plates according to the invention in the course of manufacture.

For this machining work, in so far as side faces 26 are perpendicular to top and bottom faces 22 and 24, the blanks are stacked on a support such as that shown in FIG. 6. This support comprises a base 64, positioning rods 66 (only one of them being visible), an upper clamping plate 68 and screws 70. Base 64 and plate 68 each have protruding from the outer face a cylindrical boss 71 (visible only on plate 68) for locating the stack of blanks on the machine-tool.

Base 64 and plate 68 preferably are made of brass and have the same size as the blanks before machining. The blanks are slipped on to rods 66, whose positions correspond to locating holes in the blanks. The top ends of rods 66 are formed with tapped holes for receiving screws 70.

Once firmed up by tightening screws 70 in rods 66, the assembly of blanks is mounted on a machine-tool, e.g. a digital control milling machine. The outline is then milled. The state of the surface may be fined down by, for instance, brushing, sanding or polishing. The stack is then cleaned and then placed in a chamber enabling coating material to be applied by chemical vapour deposition (CVD), or by physical vapour deposition (PVD). All necessary precautions will of course be taken by the man of the art to ensure maximum adherence of the coating material and hence good resistance to abrasion. Such maximum adherence may in some cases be achieved by applying several layers. For instance a sub-jacent layer of nickel will often be applied.

When the layer coating middle-forming portion 18 is for instance of gold, aluminium or chromium may be deposited galvanically, the blanks being stacked as described above.

This enables the outer configuration of the middle-forming portions 18 of a large number of blanks to be machined collectively and the protective coating to be applied to these blanks collectively also, the adjacent faces of adjoining blanks masking each other and the outer faces of the outermost blanks being overlaid by back 64 and plate 68.

If a more elaborate outer shape is required for middle-forming portion 18, e.g. as shown in FIGS. 4 and 5, the blanks for middles cum plates 10 will need to be machined successively. During this operation, chips are projected on to plate-forming portions 20 and are liable to damage layer 60. The machining operations should therefore be completed before applying layer 60. In so doing, side faces 26 are also coated. Depending on the material used for layer 62, it may de desirable to remove layer 60, e. g. by chemical attack, to improve the adherence of layer 62. This operation is performed after the blanks have been stacked, thereby sparing plate-forming portions 20.

Figure 7:
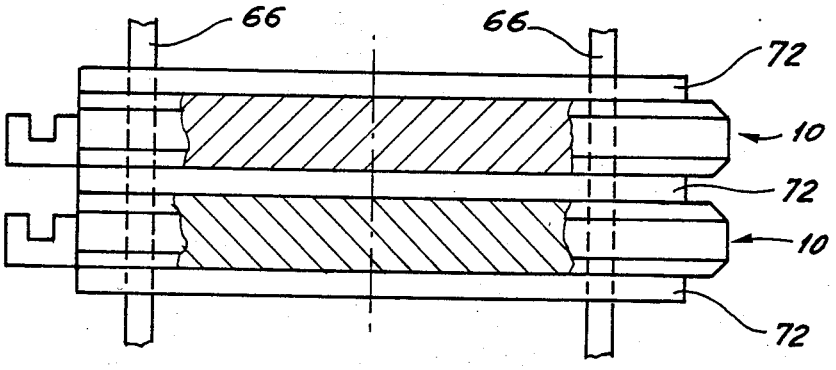
FIG. 7 is a front view partly broken away, showing another stacking arrangement for middles cum plates according to the invention.

When top and bottom faces 22 and 24 also need to be partly coated by layer 62 over their periphery, the blanks are no longer simply stacked directly on top of each other, but spacers 72 are inserted between them as shown in FIG. 7. Spacers 72 cover the regions that are protected by a glass 12 and a back 14 in an assembled watch. Thus, if a glass 12 and a back 14 are in alignment with each other, spacers 72 only need to have an area identical to those of glass 12 and back 14.

When the area that is covered by a glass 12 is larger or smaller than that covered by a back 14, two kinds of spacers 72 may be provided, one having the same area as glass 12, the other having the same area as back 14. The blanks would then be arranged with top face facing top face and bottom face facing bottom face, and with between them a correspondingly sized spacer.

Spacers 72 should be as thin as possible but sufficiently thick for material to be properly applied at the bottom of the grooves between adjacent blanks. This will be the case if the depth of the grooves is roughly equal to the thickness of spacers 72.

Layer 62 may extend under a glass 12 or a back 14 without affecting the operation of the resulting watch, but it should not extend to plate-forming portion 20.

In FIGS. 1 to 5, glass 12 is fixed directly to middle cum plate 10. It could also cooperate with a bezel, with the latter being fixed to middle cum plate 10.

It will be noted that the top and bottom faces of middle cum plate 10 are flat. The contacting faces of glass 12 and of back 14 may also be flat. The cost is thus minimal.

In a modified construction not shown, the top and bottom faces could be of any shape, adapted to receive a glass and a back of more complex design. In this case, the spacers should be so shaped as to be complementary to the surfaces with which they are intended to cooperate.

A watch can thus be produced in which all of the parts that form the frame and case are suitably protected. The cost price of the finished watch can also be appreciably reduced, without affecting its quality.

The thickness of the various layers has been exagerated in the drawings for the sake of clarity.

We claim:

1. An integral watch case middle and movement plate made of brass comprising top and bottom faces with at least one formed with recesses for receiving components of a watch movement, and side faces, and provided with a coating made of a material that is chemically more inert than brass, said coating including a first part that protects the brass in the regions of said middle and said plate that are formed with said recesses and a second part that protects the brass at least over said side faces and which is thicker and more resistant to chemical and physical attack than the first part.

2. A watch case middle and movement plate as in claim 1, wherein the periphery of at least one of said top and bottom faces is covered by the second part of said coating.

3. A watch case middle and movement plate as in claim 1, wherein the first part of said coating comprises a layer containing a metal selected from the group consisting of gold and nickel.

4. A watch case middle and movement plate as in claim 3, wherein the thickness of said layer ranges from 0.5 to 3 $\mu$m.

5. A watch case middle and movement plate as in claim 1, wherein the second part of said coating comprises a layer containing a metal selected from the group consisting of gold, chromium, titanium and aluminum.

6. A watch case middle and movement plate as in claim 5, wherein the thickness of said layer exceeds 8 μm.

7. A watch case middle and movement plate as in claim 1, wherein the second part of said coating comprises a layer containing a carbide or nitride of a metal selected from the group consisting of tungsten, vanadium and titanium.

8. A watch case middle and movement plate as in claim 7, wherein the thickness of said layer exceeds 5 μm.

9. A watch case middle and movement plate as in claim 1, wherein the second part of said coating comprises a layer containing an organic material.

10. A watch case middle and movement plate as in claim 9, wherein said organic material is an organic paint.

11. A watch case middle and movement plate as in claim 9, wherein said organic material is rubber.

12. A watch case middle and movement plate as in claim 9, wherein at least one bonding sub-layer is provided between said brass and said coating.

13. A method of making integral watch case middles and movement plates from flat brass blanks, each having top, bottom and side faces, which comprises forming recesses in the central portion of at least one of said top and bottom faces of each blank for receiving components of a watch movement, applying to the blanks a layer of material that is chemically more inert than brass to form a first part of a protective coating, stacking and assembling the blanks such that at least the central portions with the recesses are masked, and applying to the visible regions of the blanks a protective layer for said side faces forming a second part of said coating that is thicker and more resistant to chemical and physical attack than the first part.

14. A method as in claim 13, wherein the adjacent top and bottom faces of a pair of contiguous blanks once stacked and assembled mask each other.

15. A method as in claim 14, wherein the side faces of the blanks once stacked and assembled are machined collectively to define the outer shape of their middle-forming portions before applying the second part of the coating.

16. A method as in claim 13, which comprises providing spacers between the blanks while being stacked, said spacers being sized only partly to cover the adjacent ones of said top and/or bottom faces.

17. A watch having a watch case middle and movement plate as in claim 1, a glass and a back, wherein the second part of the coating protects said middle and said plate over the portions thereof that are not overlaid.

18. A watch as in claim 17, wherein the top and bottom faces of said middle and said plate are flat and parallel around their peripheral portion and said glass and back have flat parallel faces overlaying said top and bottom faces.

* * * * *